US005087049A

United States Patent [19]

Yamagishi et al.

[11] Patent Number: 5,087,049

[45] Date of Patent: Feb. 11, 1992

[54] GOLF BALL

[75] Inventors: Hisashi Yamagishi, Yokohama; Seisuke Tomita, Tokorozawa, both of Japan

[73] Assignee: Bridgestone Corporation, Tokyo, Japan

[21] Appl. No.: 555,011

[22] Filed: Jul. 20, 1990

[30] Foreign Application Priority Data

Jul. 25, 1989 [JP] Japan ..... 1-193670

[51] Int. Cl.[5] ..... A63B 37/12

[52] U.S. Cl. ..... 273/232; 40/327

[58] Field of Search ..... 273/232; 40/327

[56] References Cited

U.S. PATENT DOCUMENTS 4,681,323 7/1987 Alaki et al. ..... 273/232
4,762,326 8/1988 Gobush ..... 273/232
4,844,472 7/1989 Ihara ..... 273/232
4,974,856 12/1990 Morell ..... 273/232

*Primary Examiner*—George J. Marlo
*Attorney, Agent, or Firm*—Sughrue, Mion, Zinn Macpeak & Seas

[57] ABSTRACT

A golf ball with three dimples (14) having the same shape and an equal diameter and an equal depth are distributed about the center of each spherical regular triangle (13) such that three line segments connecting the centers of the three dimples (14) define a regular triangle (15). The length of each line segment, that is, length ($D_{D1}$) of one side of the regular triangle (15) does not exceed twice the diameter ($D_m$) of the dimples (14). No other dimples are located within the regular triangle (15) associated with the three dimples (14). Two dimples (16) having the same diameter as the three dimples (14) are distributed on each side of the spherical regular triangle (13) in symmetry with respect to its middle point such that the distance ($D_{D2}$) between the centers of the two dimples (16) does not exceed twice the diameter ($D_m$) of the dimples (16).

10 Claims, 6 Drawing Sheets

10
11
12
12
13
14
14
14

GOLF BALL

This invention relates to golf balls having at least three groups of dimples distributed in a regular octahedral arrangement. More particularly, it relates to golf balls having an improved dimple arrangement ensuring improved aerodynamic symmetry and thus an increased flying distance.

BACKGROUND OF THE INVENTION

Golf balls are required to meet aerodynamic symmetry as prescribed in Professional Golfers' Association Rule, for example, the U.S. Golf Association Rule, Appendix III, Ball (C). It is required that when hit under given conditions, a ball has essentially no difference in trajectory and distance irrespective of different hitting positions.

In the conventional golf balls, dimples are distributed in symmetry with respect to a plurality of axes in order to accomplish aerodynamic symmetry. For instance, the phantom spherical surface of a golf ball is equally divided into planes of a regular hexahedral (6-sided), octahedral (8-sided), dodecahedral (12-sided) or icosahedral (20-sided) shape in which dimples are distributed. Among others, the regular icosahedral distribution wherein the ball surface is divided into equal 20 triangles of a regular icosahedron offers the maximum number of equally divided planes in equally dividing the spherical surface and has the maximum geometrical symmetry and the maximum number of symmetry axes, and is thus believed to provide improved aerodynamic symmetry. For this reason, various designs based on the regular icosahedral distribution have been proposed and implemented in practice.

Golf players have a consistent need for golf balls having improved flying performance. A variety of dimple arrangements have been proposed in order to improve flying performance, especially flying distance. Some golf balls whose dimple arrangement has improved flying performance, but less aerodynamic symmetry can be limited on use by the above-mentioned Rule. Therefore, the mainstream dimple arrangement is the regular icosahedral distribution.

However, other than the regular icosahedral distribution, regular octahedral and some other distributions are considered to provide dimple distributions having improved flying performance. There is a need for a regular octahedral or similar dimple distribution capable of meeting both the requirements of flying performance and aerodynamic symmetry.

SUMMARY OF THE INVENTION

Therefore, an object of the present invention is to provide a golf ball having a regular octahedral dimple distribution and providing improved flying performance and aerodynamic symmetry.

According to the present invention, there is provided a golf ball having at least three groups of dimples on the surface thereof. As a premise, the ball has a phantom spherical surface, three first phantom orthogonal great circles are drawn on the spherical surface to define eight equal spherical regular triangles, each spherical regular triangle being delimited by three sides and having a center and middle points on the three sides, and four second phantom orthogonal great circles are drawn on the spherical surface, each second phantom great circle connecting the middle points on two of the three sides delimiting the spherical regular triangle. Three dimples having the same figure and an equal diameter and an equal depth are distributed about the center of each spherical regular triangle such that three line segments connecting the centers of the three dimples define a regular triangle and the length of each line segment, that is, one side of the regular triangle does not exceed twice the diameter of the dimples, with the proviso that no other dimples are located within the regular triangle associated with the three dimples. Two dimples having the same diameter as the three dimples are distributed on each side of the spherical regular triangle in symmetry with respect to its middle point such that the distance between the centers of the two dimples does not exceed twice the diameter of the dimples. None of the dimples intersect the second phantom great circles.

The above-defined dimple arrangement allows dimples of three groups to be evenly distributed on an average without local concentration of dimples of an equal diameter. This results in a golf ball having both improved aerodynamic symmetry and flying performance.

BRIEF DESCRIPTION OF THE DRAWINGS

The above and other objects, features, and advantages of the present invention will be better understood from the following description taken in conjunction with the accompanying drawings, in which:

FIGS. 1 and 2 are geometrical illustrations of a golf ball, showing the dimple distribution of the invention, FIG. 1 showing the entire spherical ball surface and FIG. 2 being an enlarged view of one spherical regular triangle;

DESCRIPTION OF THE PREFERRED EMBODIMENTS

Figure 1:
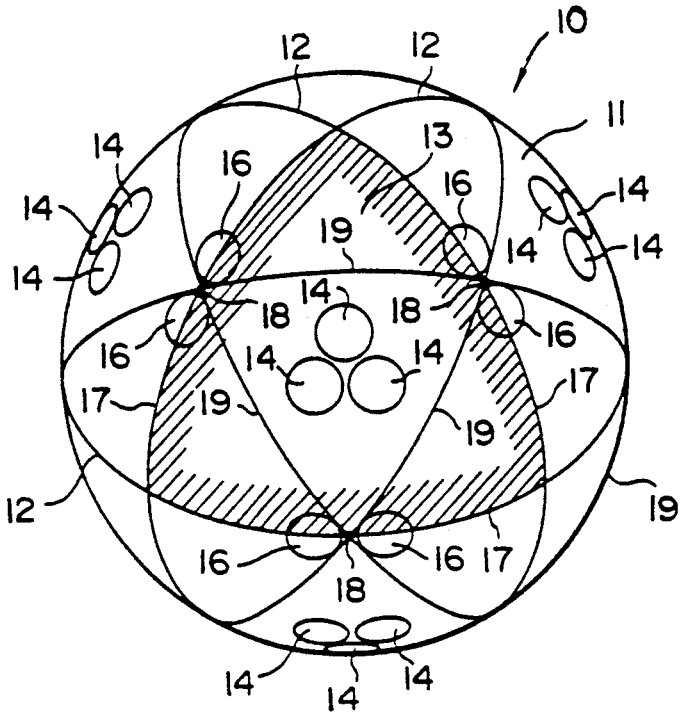

Referring to FIGS. 1 and 2, there is illustrated the geometry of a golf ball designated at 10. The ball 10 has a phantom spherical surface 11. Three first phantom orthogonal great circles 12, 12, and 12 are drawn on the spherical surface 11 to define eight spherical regular triangles 13, 13, ... so that the spherical ball surface 11 is equally divided into eight sections. Each spherical regular triangle 13 is delimited by three sides 17, 17, and 17 and has a center (not shown) and middle points 18 on the three sides 17, 17, and 17. Four second phantom orthogonal great circles 19, 19, 19, and 19 are then drawn on the spherical surface, each great circle 19 connecting the middle points 18 and 18 on two of the three sides 17, 17, and 17 delimiting the spherical regular triangle 13.

At least three groups of dimples are distributed in conjunction with the spherical regular triangles 13. Three dimples 14, 14, and 14 having the same figure and an equal diameter Dm and an equal depth are distributed about the center of each spherical regular triangle 13 such that three line segments connecting the centers of the three dimples 14, 14, and 14 define a regular triangle 15 and each line segment, that is, one side of the regular triangle 15 has a length $D_{D1}$ which does not exceed twice the diameter Dm of each dimple 14 (that is, $D_{D1} \leqq 2Dm$). No other dimples are located within the regular triangle 15 associated with the three dimples 14, 14, and 14. Further, two dimples 16 and 16 having the same diameter Dm as the three dimples 14, 14, and 14 are distributed on each side 17 of the spherical regular triangle 13 in symmetry with respect to its middle point 18 such that the distance $D_{D2}$ between the centers of the two dimples 16 and 16 does not exceed twice the diameter Dm of each dimple 16 (that is, $D_{D2} \leqq 2Dm$). None of the dimples intersect the great circles 19, 19, 19, and 19. The two dimples 16 and 16 have the same figure and an equal diameter. The two dimples 16 and 16 may have the same depth as or a different depth from the three dimples 14, 14 and 14 although it is preferred that the two dimples 16 and 16 have the same depth as the three dimples 14, 14 and 14.

Figure 3:
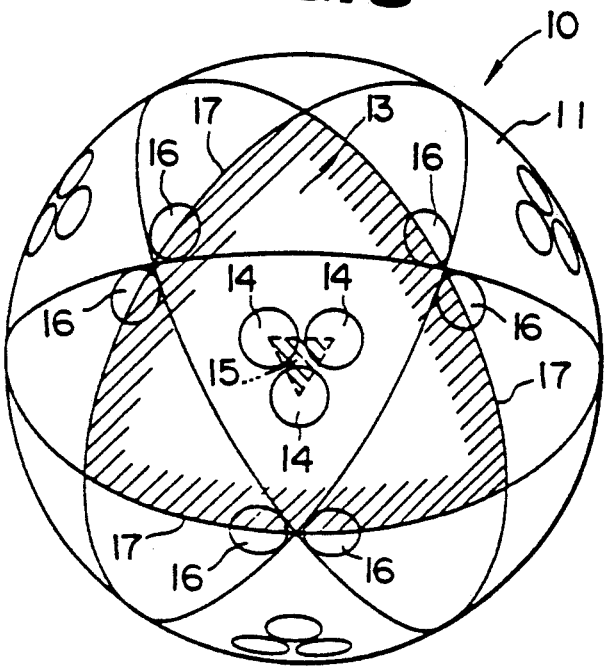
FIGS. 3 and 4 are plan views showing different distribution patterns of dimples on golf balls according to the invention.
Figure 4:
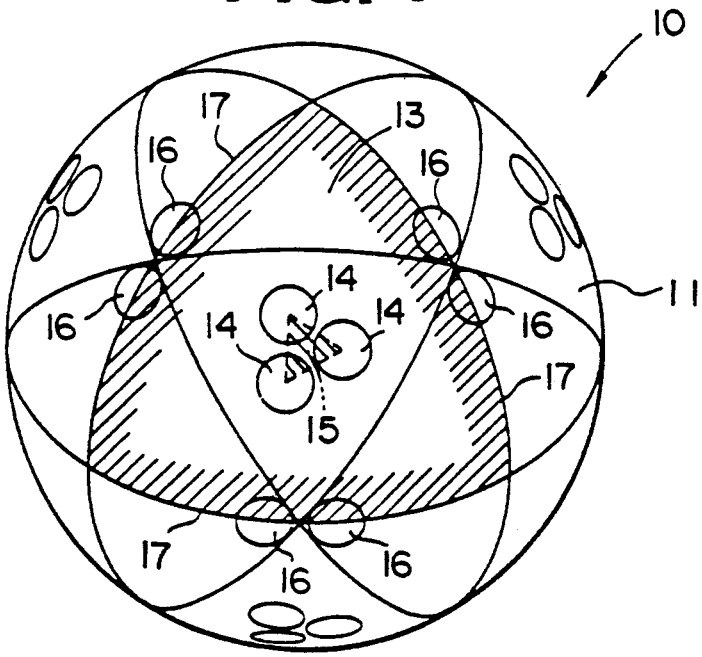

The three dimples 14, 14, and 14 arranged about the center of the spherical regular triangle 13 are not limited to the distribution shown in FIG. 1, but either of the distributions shown in FIGS. 3 and 4 may be used instead. More particularly, in the FIG. 1 distribution, the sides of the inner regular triangle 15 associated with the three dimples 14, 14, and 14 are approximately parallel to the three sides 17, 17, and 17 of the outer spherical regular triangle 13. In the FIG. 3 distribution, the inner triangle 15 is inverted from that of FIG. 2. In the FIG. 4 distribution, the inner triangle 15 is rotated an angle about the center from that of FIG. 2. This means that the orientation of the inner triangle 15 with respect to the outer triangle 13 is not critical.

It is understood that one of the great circles 19, 19, 19, and 19 with which none of the dimples intersect can be the seam line which is created on golf balls during their manufacture at the interface between mating mold halves.

The golf ball of the invention includes at least three groups of dimples, preferably 3 to 6 groups of dimples. The dimples have a circular shape in a plan view, that is, when viewed in a radial direction with respect to the ball. The dimples of different groups are different in diameter and/or depth.

In a golf ball with n groups of dimples wherein n is a positive integer of at least 3, further improvements in flying distance and aerodynamic symmetry are achieved when the total dimple surface area quotient Dst is at least 4. The total dimple surface area quotient Dst is given by the following expression:

$$Dst = \frac{n \sum_{k=1}^{n} [(Dmk^2 + Dpk^2) \times Vok \times Nk]}{4R^2} \quad (1)$$

In the expression,

Nk is the number of dimples belonging to each group k wherein k is 1, 2, 3, ..., and n, Dmk is the diameter of dimples belonging to group k, Dpk is the depth of dimples belonging to group k, R is the radius of the ball, and Vo is a value obtained by dividing the volume of the dimple space defined between the surface of a dimple k and a plane defined by the periphery of the dimple k by the volume of a cylinder having said plane defined by the periphery of the dimple k as its base and the maximum depth of the dimple k as its height. With respect to Vo, reference is made to Japanese Patent Application Kokai No. 163674/1985 (U.S. Pat. No. 4,681,323 or British Patent No. 2,153,690). Preferably Vo is in the range of from 0.3 to 0.6, especially 0.44 to 0.5 as an average of all the dimples.

In the dimple distributions of FIGS. 1 to 4, the dimples 14 and 16 preferably have a larger diameter among the three or more groups, more preferably the largest or next-to-largest diameter. The diameter Dm of these dimples 14 and 16 is preferably in the range from 3.6 to 4.3 mm, more preferably from 3.65 to 4.1 mm. The dimples 14 and 16 preferably have a depth in the range of from 0.15 to 0.24 mm, more preferably from 0.16 to 0.21 mm. Further, the length $D_{D1}$ of each side of the regular triangle 15 or between the dimples 14 centers preferably ranges from 3.6 to 8.6 mm, more preferably from 3.65 to 8.2 mm. Also the length $D_{D2}$ between the dimples 16 centers is preferably in the range from 3.6 to 8.6 mm, more preferably from 3.65 to 8.2 mm.

The dimples of the other groups are evenly distributed on the eight spherical regular triangles 13. In distributing at least three groups of dimples which are different in diameter and/or depth on the respective spherical regular triangles 13, the number of dimples belonging to the same group is equal among the triangles 13. Where at least three groups of dimples are arranged on each spherical regular triangle 13, the dimples are uniformly distributed, that is, have the same distribution pattern with respect to a symmetrical axis which is a perpendicular from each apex of the triangle 13 to the opposing side. As previously described, the dimples do not intersect the second phantom great circles 19, but some can intersect the first phantom great circles 12. It is also permissible that some dimples position at the apexes of each spherical regular triangle 13. The other dimples preferably have a diameter of 2.00 to 4.20 mm, more preferably from 2.30 to 4.00 mm and a depth of 0.15 to 0.24 mm, more preferably from 0.16 to 0.21 mm.

The golf ball of the invention generally bears 350 to 570 dimples, preferably 390 to 560 dimples in total. The total number of the specifically located dimples 4 and 6 is 48 since eight regular triangles are defined on the ball surface by three first phantom great circles. Then the number of the dimples 4 and 6 and dimples having the same shape is 48 or more. The proportion of the specifically located dimples is preferably 10 to 70%, more preferably 20 to 70% of the total dimples. When the specifically located dimples occupy 10 to 70% of the total dimples, the specifically located dimples are distributed such that more than two of them do not closely adjoin each other. Those dimples having the smallest diameter should preferably be 10 to 40% of the total dimples.

The dimple distribution defined by the present invention may be applied to any type of golf ball including solid golf balls such as one- and two-piece golf balls and thread-wound golf balls. The golf balls can be prepared by conventional techniques. It should be appreciated that the balls include both small balls having a diameter of at least 41.15 mm and a weight of up to 45.92 g, and large balls having a diameter of at least 42.67 mm and a weight of up to 45.92 g.

EXAMPLE

Examples of the invention are given below by way of illustration and not by way of limitation.

EXAMPLES 1-6

There were prepared two-piece golf balls of the large size (42.67 mm diameter). Each ball had dimples whose dimension, number, and distribution pattern are shown in Table 1. Except the dimples, the remaining components were the same for all the balls. The dimple distribution patterns used are shown in FIGS. 5 through 10. In the figures, numeral 1 designates the largest dimples, 2 designates second largest dimples, and so forth.

Examples 5 and 6 are outside the scope of the invention.

TABLE 1

Figure 5:
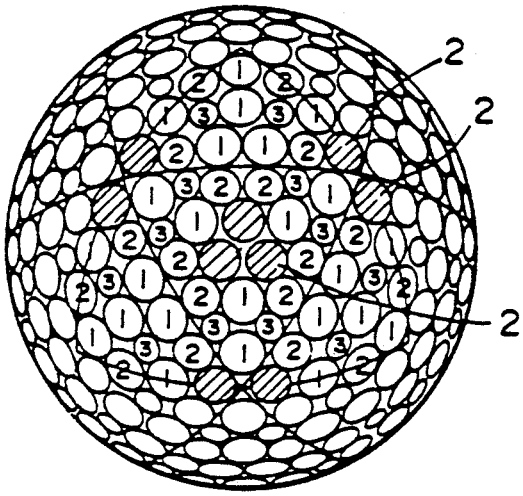
FIGS. 5 to 8 are plan views showing further embodiments of the invention.
Figure 6:
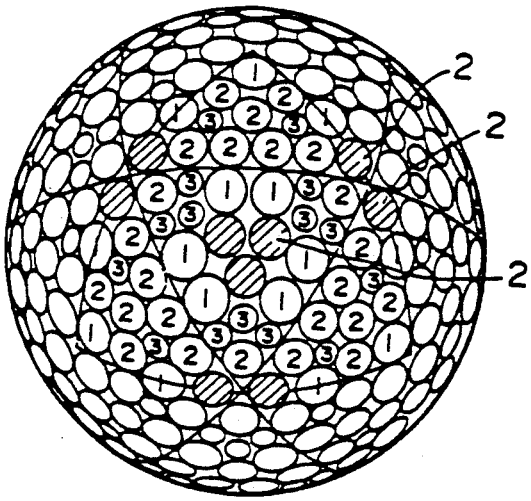
Figure 7:
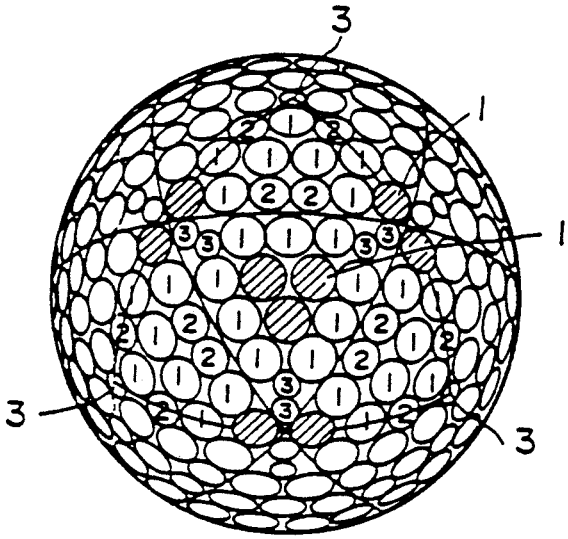
Figure 8:
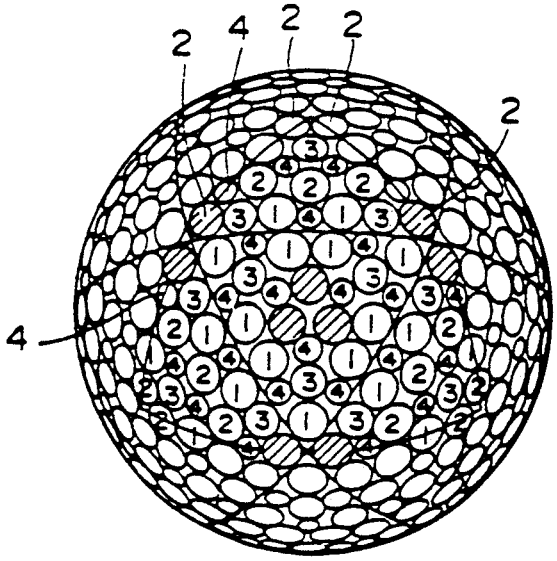
Figure 9:
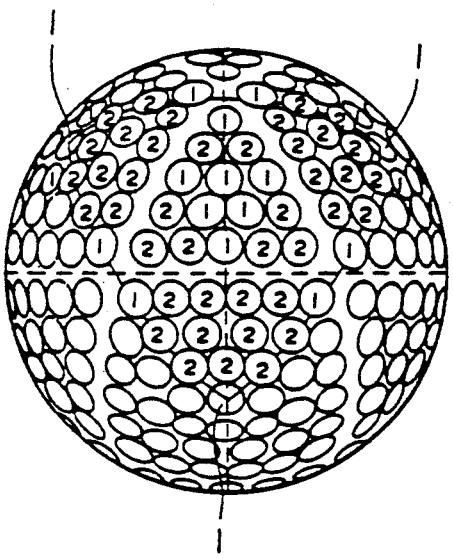
FIGS. 9 and 10 are plan views showing dimple arrangements outside the scope of the invention.
Figure 10:
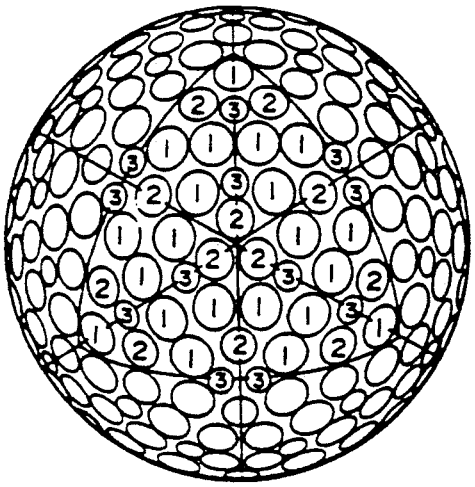

| Dimple groups | | | | Overall dimples | | |
|---|---|---|---|---|---|---|
| Example | Group | Dia. × Depth × Number | % | Vo | Dst | Pattern |
| 1 | 1 | 4.05 mm × 0.215 mm × 240 | 55.6 | | | |
| | 2 | 3.45 mm × 0.190 mm × 96 | 22.2 | 0.480 | 4.54 | FIG. 5 |
| | 3 | 2.60 mm × 0.155 mm × 96 | 22.2 | | | |
| 2 | 1 | 4.15 mm × 0.205 mm × 96 | 21.2 | | | |
| | 2 | 3.70 mm × 0.190 mm × 240 | 52.6 | 0.465 | 4.30 | FIG. 6 |
| | 3 | 2.35 mm × 0.130 mm × 120 | 26.3 | | | |
| 3 | 1 | 4.10 mm × 0.210 mm × 240 | 67.7 | | | |
| | 2 | 3.60 mm × 0.185 mm × 96 | 18.5 | 0.450 | 4.24 | FIG. 7 |
| | 3 | 2.50 mm × 0.145 mm × 96 | 13.8 | | | |
| 4 | 1 | 3.65 mm × 0.200 mm × 144 | 26.6 | | | |
| | 2 | 3.50 mm × 0.190 mm × 144 | 26.6 | 0.480 | 5.94 | FIG. 8 |
| | 3 | 3.30 mm × 0.185 mm × 96 | 17.4 | | | |
| | 4 | 2.30 mm × 0.150 mm × 168 | 30.4 | | | |
| 5* | 1 | 3.65 mm × 0.230 mm × 78 | 21.3 | | | |
| | 2 | 3.45 mm × 0.220 mm × 288 | 78.7 | 0.480 | 2.36 | FIG. 9 |
| 6* | 1 | 4.05 mm × 0.225 mm × 168 | 50.0 | | | |
| | 2 | 3.75 mm × 0.195 mm × 96 | 28.6 | 0.470 | 3.54 | FIG. 10 |
| | 3 | 2.50 mm × 0.150 mm × 72 | 21.4 | | | |

*outside the scope of the invention

The balls were tested for flying performance, that is, carry and total flying distance (carry plus run) by hitting with a driver at a head speed of 45 m/sec. They were also evaluated for aerodynamic symmetry by the hitting test prescribed in USGA Rule, Appendix III, Ball (C).

Figure 11:
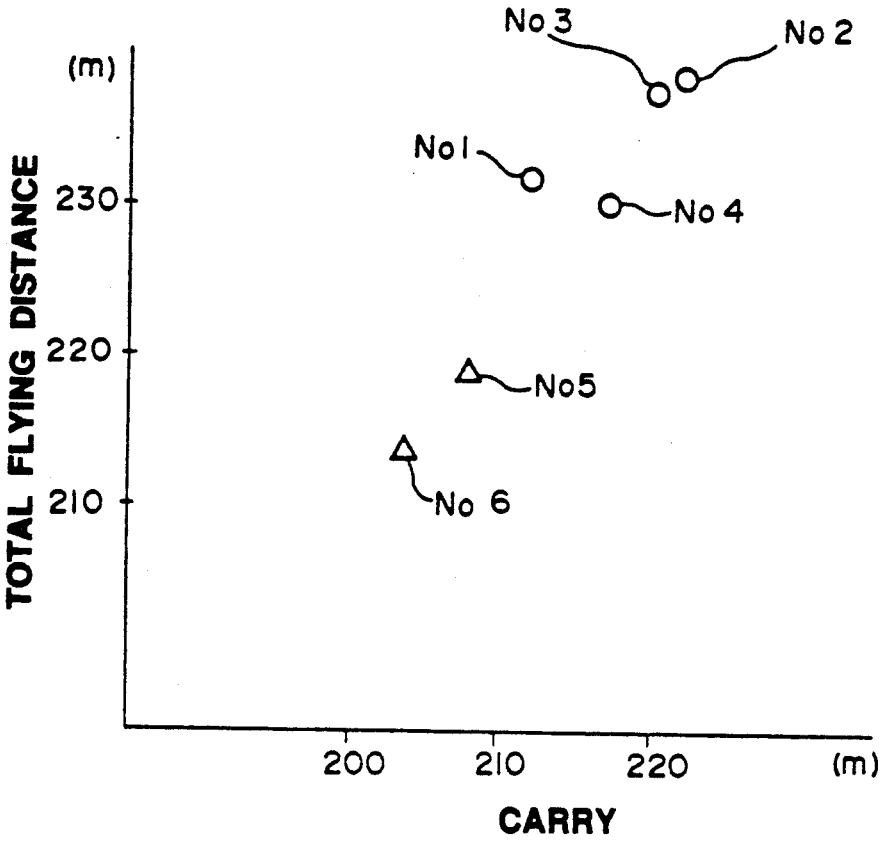
FIG. 11 is a graph showing the flying performance of golf balls, Nos. 1 to 6.
Figure 12:
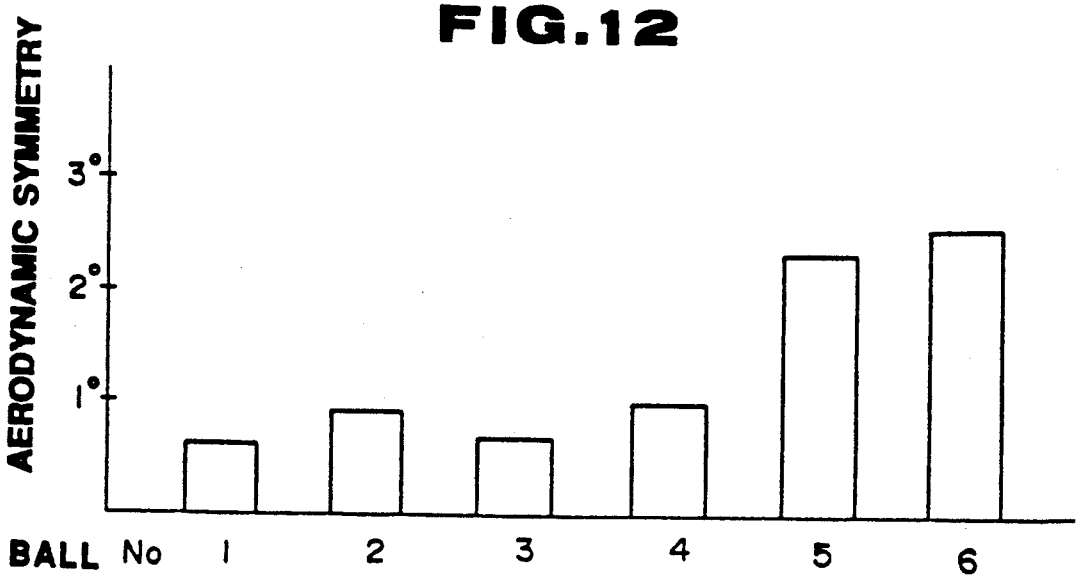
FIG. 12 is a graph showing the results of an aerodynamic symmetry evaluation test on golf balls, Nos. 1 to 6.

The results are shown in FIGS. 11 and 12.

There has been described a golf ball having dimples properly located in a regular octahedral distribution such that aerodynamic symmetry and flying distance are increased at the same time.

Although some preferred embodiments have been described, many modifications and variations may be made thereto in the light of the above teachings. It is therefore to be understood that within the scope of the appended claims, the invention may be practiced otherwise than as specifically described.

We claim:

1. A golf ball having groups of dimples on the surface thereof, wherein provided that the ball has a phantom spherical surface (11), three first phantom orthogonal great circles (12) are drawn on the spherical surface (11) to define eight equal spherical regular triangles (13), each spherical regular triangle (13) being delimited by three sides (17) and having a center and middle points (18) on the three sides (17), and four second phantom great circles (19) are drawn on the spherical surface (11), each second phantom great circle (19) connecting the middle points (18) on two of the three sides (17) delimiting the spherical regular triangle (13), each spherical regular triangle (13) having three segments of the second phantom great circles (19);

a group of three dimples (14) having the same shape and an equal diameter and an equal depth is distributed about the center of each spherical regular triangle (13) such that three line segments connecting the centers of the three dimples (14) define a regular triangle (15) and the length of each line segment ($D_{D1}$) of of one side of the regular triangle (15) does not exceed twice the diameter (Dm) of the dimples, and not other dimples are located within the regular triangle (15) associated with the three dimples (14), a group of two dimples (16) having the same diameter as the three dimples (14) is distributed on each side of the spherical regular triangle (13) in symmetry with respect to its middle point such that the distance ($D_{D2}$) between the centers of the two dimples (16) does not exceed twice the diameter (Dm) of the dimples (16), and none of the dimples intersect the second phantom great circles (19).

2. The golf ball of claim 1 wherein one of the second phantom great circles coincides with a seam line resulting from the ball manufacture.

3. The golf ball of claim 1 wherein 350 to 570 dimples are present in total.

4. The golf ball of claim 1 wherein said golf ball has 6 groups of dimples.

5. The golf ball of claim 4 wherein a total dimple surface area quotient Dst is at least equal to 4, where:

$$Dst = \frac{n \sum_{k=1}^{n} [(Dmk^2 + Dpk^2) \times Vok \times Nk]}{4R^2} \quad (1)$$

In the expression,

Nk is the number of dimples belonging to each group k wherein k is 1, 2, 3, ... and n, Dmk is the diameter of dimples belonging to group k, R is the radius of the ball, and Vo is a value obtained by dividing the volume of the dimple space defined between the surface of a dimple k and a defined by the periphery of the dimple k by the volume of a cylinder having said plane defined by the periphery of the dimple k as its base and the maximum depth of the dimple k as its height.

6. The golf ball of claim 1 wherein said diameter Dm of said dimples is in the range of 3.6 to 4.3 mm.

7. The golf ball of claim 1 wherein the length of each line segment $D_{D1}$ is in the range of 3.6 to 8.6 mm.

8. The golf ball of claim 1 wherein the length of each line segment $D_{D2}$ is in the range of 3.6 to 8.6 mm.

9. The golf ball of claim 1 wherein said golf ball is solid.

10. The golf ball of claim 1 wherein said golf ball is thread wound.

* * * * *